United States Patent [19]

Bumgardner

[11] 4,398,166

[45] Aug. 9, 1983

[54] COMPENSATOR FOR CRT DEFLECTION YOKES AND THE LIKE

[75] Inventor: Donald L. Bumgardner, South Lyon, Mich.

[73] Assignee: Northern Telecom Inc., Nashville, Tenn.

[21] Appl. No.: 268,730

[22] Filed: Jun. 1, 1981

[51] Int. Cl.[3] ..... H01F 7/00

[52] U.S. Cl. ..... 335/212; 335/210

[58] Field of Search ..... 335/212, 210

[56] References Cited

U.S. PATENT DOCUMENTS 3,852,693 12/1974 Schwalm ..... 335/212

4,109,220 8/1978 Peart ..... 335/212

*Primary Examiner*—Harold Broome

*Attorney, Agent, or Firm*—Price, Heneveld, Huizenga & Cooper

[57] ABSTRACT

A compensator for CRT deflection yokes and the like comprises a housing shaped for connection with the deflection yoke, and at least one magnet rotatably mounted therein. Selective rotation of the magnet alters the electromagnetic field produced by the deflection yoke to alleviate distortion in the CRT display. A detented spring arrangement positively and releasably retains the magnet in a set, adjusted angular position in the housing.

14 Claims, 10 Drawing Figures

PRIOR ART

COMPENSATOR FOR CRT DEFLECTION YOKES AND THE LIKE

BACKGROUND OF THE INVENTION

The present invention relates to cathode ray tubes, and to magnetic deflection yokes used in such devices; in particular the invention relates to magnetic compensation for CRT deflection yokes and the like.

Cathode ray tubes (CRT's) are used extensively in the communication of visual images, such as in television receivers, data processors, word processors, and many other such devices. In some types of CRT's, the movement or scanning functions of the electron beam is controlled by an external deflection yoke which surrounds the neck portion of the vacuum tube. Due to the angle at which the electron beam impinges upon the curved, phosphorescent tube surface, distortion of the resultant images can occur, particularly at the marginal edge of the screen. Barrel and pin-cushion distortion are worsened in compact (short-necked), wide-angle tubes, such as those having a sidewall inclination in the range of 110°. Further, the effect of this distortion is particularly critical in the display of alphanumeric symbols, as severe distortion can cause difficulty in reading, or even misinterpretation of the displayed images.

Because of the above-noted distortion effects, some CRT displays now utilize stator yokes, with built-in circuitry to reduce such image distortion. However, such constructions are many times more expensive than the typical saddle-torroid type of deflection yokes, and for this reason such yokes are very frequently used, despite the prevalent distortion. It is to this problem that the present compensator is addressed, and for which it is adapted to be used.

One type of compensator previously used with CRT's having external deflector yokes is shown in FIG. 1 of the drawings, and comprises an encirclement for the neck of the CRT which carries a plurality of outwardly-extending, plastic-coated pins. Each such pin has a pair of spaced-apart magnets frictionally retained on the outer end thereof by an interference fit over the plastic-coated pins. The inner ends of the pins are fixedly anchored in the forward collar of the deflection yoke, and the magnets can be rotated axially on the pins. To alleviate distortion in screen-displayed images, the CRT is activated with a test pattern, and an operator manually rotates the magnets until distortion has been minimized. In this type of compensator, the magnets are very difficult, if not impossible to adjust accurately, since they are in effect jammed into their respective pins and do not rotate smoothly increment-by-increment upon their pins. In addition to being rather inaccurate, this type of adjustment is a tedious, time-consuming procedure. Furthermore, and most disadvantageously, vibrations and other jolts or jars experienced by the CRT during transport, installation, and the like, tend to jar or jostle the magnets out of adjustment. Even the inevitable exposure to heat fluctuations during normal operation can result in changes of position in the magnets, altering their preset, adjusted compensation effect.

SUMMARY OF THE INVENTION

One aspect of the present invention is to provide a low-cost compensator for CRT deflection yokes and the like, which can easily be accurately adjusted to minimize image distortion, and which retain their adjusted position on an essentially permanent basis. In accordance with the present invention, the compensator preferably includes wheel-mounted magnets which can be easily adjusted, thereby reducing production time and cost. Further, a mechanism is provided to positively and releasably retain the wheel-mounted magnets in their adjusted position. Preferably, the retaining mechanism comprises a detented leaf spring and serrated magnet wheel edge which securely retains the magnet wheels in their preset position, and also provides an adjustment means which is sensitive to both sound and touch for ease of adjustment. The magnet-carrying wheels are mounted in a housing to provide for easy mounting upon the deflection yoke while nonetheless providing accurate positioning and positive position retention. The wheel housing preferably is of a two-piece construction comprising interchangeable halves, which provides manufacturing and assembly efficiency, and the housing orients the magnet wheels in a plane substantially perpendicular to the central axis of the yoke. Preferably, each such housing half is an integral structure providing mounting and indexing structure for the magnet wheels as well as for the housing itself.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 2:
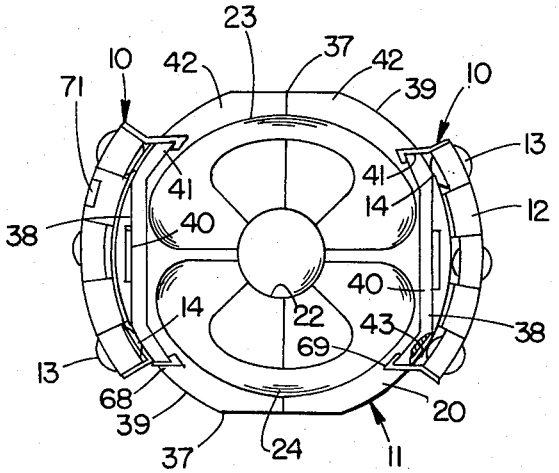
FIG. 2 is a front elevational view of a compensator embodying the present invention, shown mounted up a typical deflection yoke.

For purposes of description herein, the terms "upper", "lower", "right", "left", "rear", "front", "vertical", "horizontal", and derivatives thereof are used for convenience to describe the preferred embodiment as shown and oriented in FIG. 2. However, it is to be understood that the invention may assume various alternative orientations, except where expressly specified to the contrary.

Figure 1:
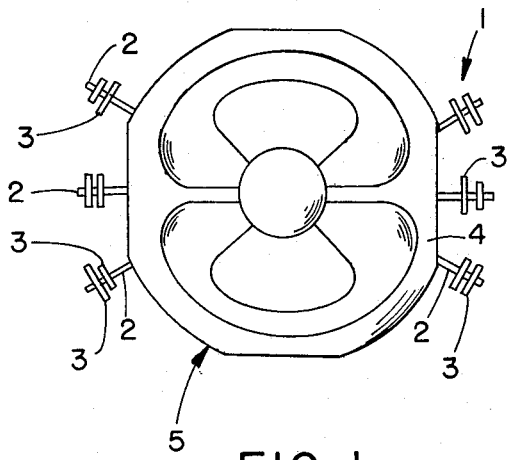
FIG. 1 is a front elevational view of a prior art compensator for CRT deflection yokes.

A prior art compensator 1 is shown in FIG. 1, and comprises a plurality of outwardly-extending, plastic-coated pins 2 having a pair of spaced-apart magnets 3 frictionally retained on each pin 2. Pins 2 are arranged in two groups of three, disposed on the left and right-hand sides of the yoke, with the inner ends of pins 2 fixedly anchored in the forward collar 4 of deflection yoke 5. Magnets 3 have a generally rectangular shape, and are axially rotatable on pins 2. Yoke 5 includes a central sleeve 6 through which the neck portion of a cathode ray tube (not shown in FIG. 1) is telescopingly received.

The reference numeral 10 (FIG. 2) generally designates a compensator apparatus embodying the present invention, adapted for mounting upon a CRT deflection yoke 11, or similar magnetically-compensatable structure. Compensator 10 includes a housing 12 having at least one wheel (i.e., rotatable or rockable member) which carries a magnet 13 therein or thereon. Selective rotation of wheel 13 alters the electromagnetic field normally produced by deflection yoke 11 and acting upon the electron beam of the CRT, to alleviate the effects of distortion in the CRT display. A detented spring arrangement 14 positively and releasably retains wheel-magnet assembly 13 in a set, angularly adjusted position in housing 12.

Figure 3:
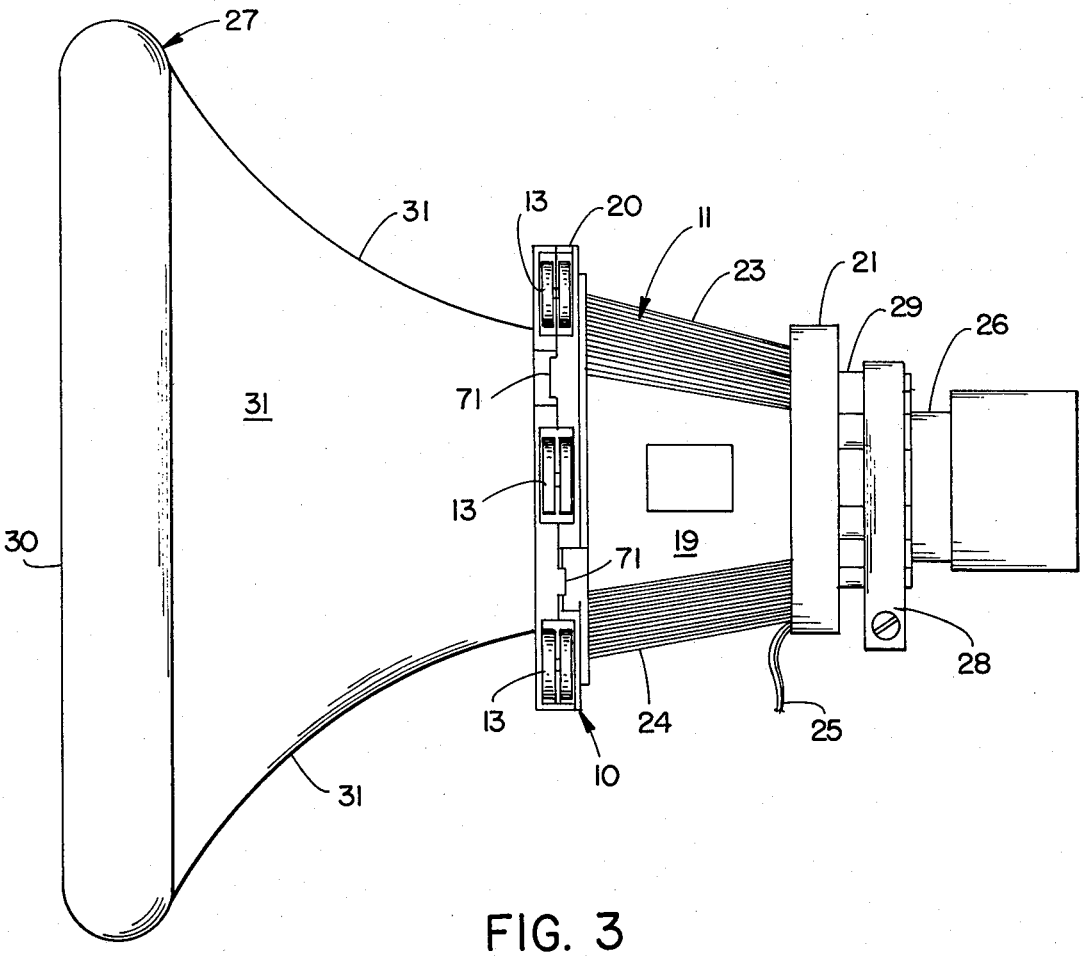
FIG. 3 is a side elevational view of the compensator and deflection yoke illustrated in FIG. 2, shown attached to a typical CRT.

Compensator 10 is particularly adapted for use in connection with that type of deflection yoke illustrated in FIGS. 1 and 2, which is the type known in the trade as a "Roland" deflection yoke. As best illustrated in FIGS. 2 and 3, the illustrated deflection yoke 11 has a generally frustoconically-shaped body 19 with forward and rearward collars 20 and 21 respectively, and a central interior sleeve 22 (FIG. 2). Two sets of coils 23 and 24 which are shaped to complement the shape of the body of yoke 19, are carried upon the yoke body, and these are selectively energized through conductors 25 to control the position or scanning function of the electron beam. As best illustrated in FIG. 3, deflection yoke 11 is adapted to be telescopingly received over the neck portion 26 of cathode ray tube 27. A split sleeve 28 is attached to the rearward end 29 of yoke 11 to securely retain the same in place on CRT 27. In this example, CRT 27 is a compact, wide-angle tube, wherein screen 30 is positioned relatively close to the rearward end of tube 27, and the tube sidewalls 31 flare outwardly at an angle in the nature of 110°.

The forward yoke collar 20 (FIG. 2) has upper end lower straight edges 37, and left and right-hand straight side edges 38, which are interconnected by arcuate edge segments 39. The conventional "Roland" type of deflection yoke 5 typically has a pair of permanent magnets (not shown) fixedly mounted along the upper and lower edges 37 of forward collar 20, for fine-tuning coils 23 and 24. A pair of outwardly-projecting flanges 40 extend along the side edges 38 of forward collar 20, and include horizontally-oriented projecting ends 41 which are adapted for attaching the compensator 10 to the deflection yoke 11, as described in greater detail hereinafter. A channel 43 is formed between forward collar 20 and flanges 40 along the outer edges thereof. The body 19 of illustrated yoke 11 has a two-piece construction with left and right-hand segments 42 which are split vertically along the central axis of the yoke. Each body segment 42 is constructed of an integrally molded, non-magnetic material, such as a suitable synthetic resin.

Figure 6:
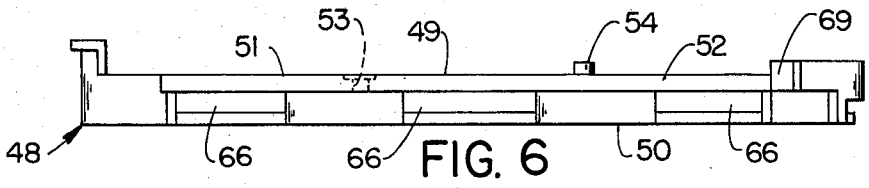
FIG. 6 is a bottom plan view of the compensator housing half.
Figure 5:
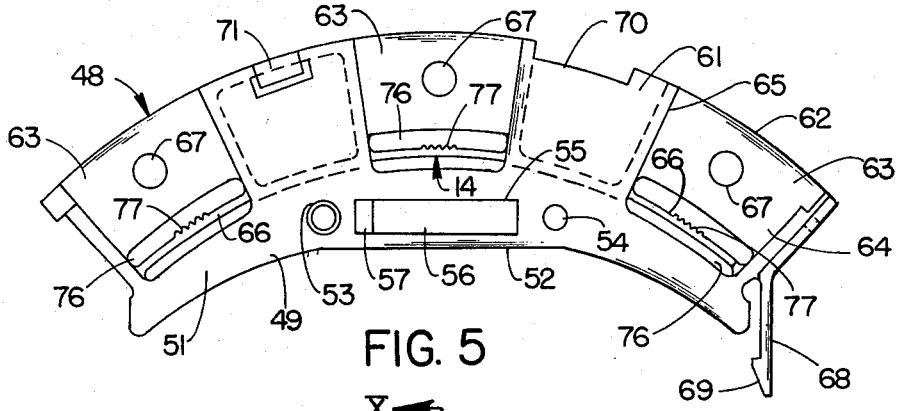
FIG. 5 is a side elevational view of the interior of the compensator housing half.
Figure 4:
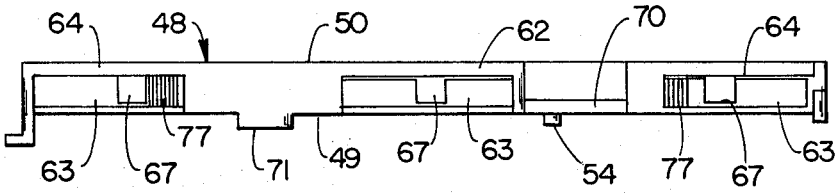
FIG. 4 is a top plan view of one housing half for the compensator.

As best illustrated in FIGS. 4–7, compensator housing 12 preferably has a two-piece construction, with interchangeable halves 48, each of which may be integrally molded in one piece from a non-magnetic, synthetic resin material such as polycarbonate, for example, like that known in the trade as "Lexan". One of the interchangeable housing halves 48 is illustrated in FIGS. 4–6.

As seen in FIGS. 4–6, housing half 48 generally includes an interior side 49 and an exterior side 50. Housing half 48 also includes a base flange 51, having a lower edge 52 which is shaped to be received into the channel 43 formed between forward yoke collar 20 and yoke flanges 40. A sleeve 53 and pin 54 protrude from the interior side 49 of the housing half, in a spaced-apart and aligned fashion. Pin 54 is sized to be telescopically received into the sleeve 53 of a second housing half 48, for interconnecting the two housing halves, as described in greater detail hereinafter. A recess 55 is integrally formed in flange 51 between sleeve 53 and pin 54, and includes a back wall 56 with an aperture or window 57 positioned through the left-hand end. In this example, recess 55 is rectangular in shape, and adapted to receive and retain a similarly-shaped permanent magnet therein.

Housing half 48 is shaped to extend outwardly from flange 51, along a flat wall 61, coplanar with such flange, and includes a generally arcuate outer edge 62, such that each housing half is generally in the shape of a crescent. Wall 61 includes three circumferentially-spaced pockets 63 therein, each having a back wall 64, radially-extending sidewalls 65, and a leaft spring 66 extending between sidewalls 65 at the base of the pocket. Each pocket back wall 64 includes a pin 67 projecting perpendicularly from the interior side of the housing half to a position substantially coplanar with the interior side of flange 51. The right-hand end of the housing half 48 includes a downwardly-projecting prong or arm 68 having an inwardly-facing barb 69 on the terminal end thereof, for attaching the compensator to deflection yoke 11. The rear housing wall 61 also includes a notch 70 in the outer edge 62 thereof between the center and right-hand pockets 63 (as viewed in FIG. 5). The corresponding sidewall portion 61 between the center and left-hand pockets (as viewed in FIG. 5) includes a tab 71 which protrudes from the interior side 49 of the housing half.

Figure 7:
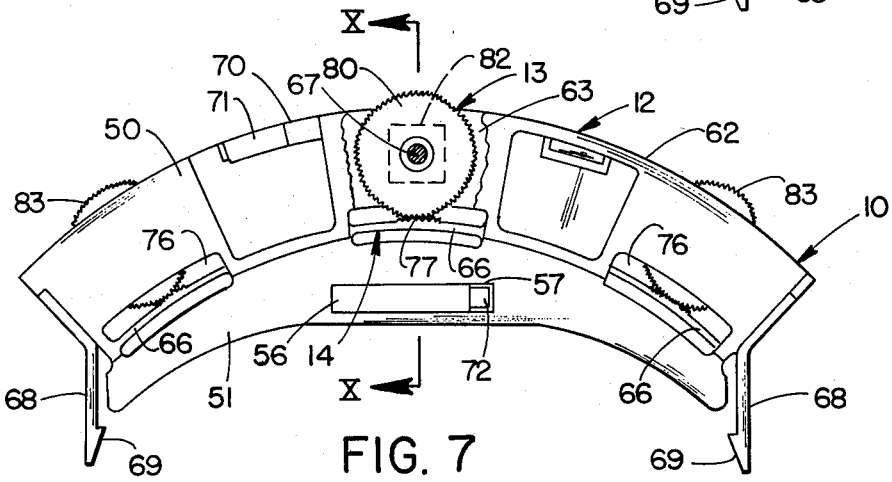
FIG. 7 is a front elevational view of the compensator, with a portion thereof broken away to reveal internal construction.

To assemble a complete housing 12, two housing halves 48 are positioned with their interior sides 49 adjacent each other, in an aligned relationship. The housing halves 48 are converged, with the pins 54 on flange 51 being received in corresponding sleeve 53 to interconnect the interior sides of the housing halves. Tabs 71 are snapped over the corresponding notches 70 into engagement with the adjacent housing sidewall, to interconnect the outer edges of the housing half with a snap lock, as shown in FIG. 7. When two housing halves 48 are interconnected, the assembly includes a barbed fastener prong 68 at each end of the same, and pockets 63 form three enclosures in which the wheel-magnet assemblies 13 are mounted. Recesses 55 form a rectangular receptacle in which a permanent magnet 72 is retained. The ends of magnet 72 are visible through windows 57, and are preferably color-coded to insure correct polar orientation.

Each pocket rear wall 64 extends from outer edge 62 to a point spaced outwardly from edge 52 of flange 51, so as to form an aperture or window 76 at the base area of each pocket, in which leaf spring 66 is positioned.

Each leaf spring 66 is preferably integrally molded with its respective housing half, and includes teeth-like ridges, in the nature of laterally-extending detents or serrations 77 at the center portion of the spring. The illustrated detents 77 have an inverted V-shape, with adjacent inclined surfaces angled approximately 120° apart, and with a root depth in the nature of 0.0105 inches. The left springs 66 are resiliently flexible in the radial direction, and serve to positively and releasably retain the wheel-magnet assemblies 3 in a preselected, rotatable adjusted position, as described in greater detail hereinafter.

Figure 8:
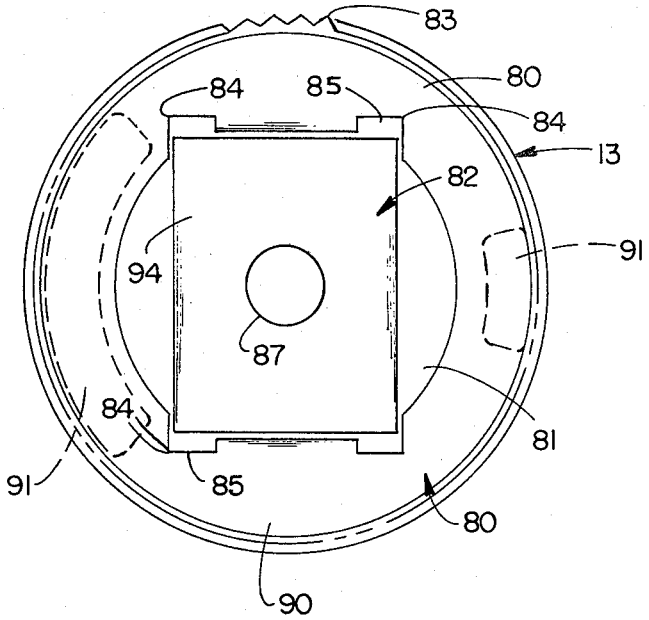
FIG. 8 is an enlarged, elevational view of a wheel portion of the compensator, shown with a magnet mounted therein.
Figure 9:
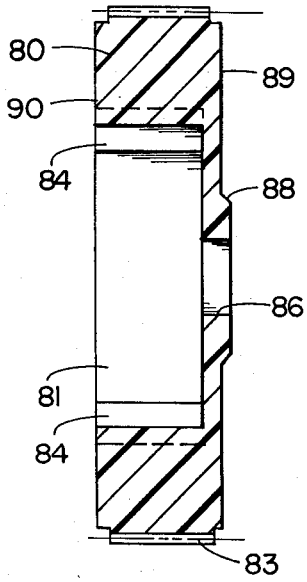
FIG. 9 is an enlarged, cross-sectional view of the compensator wheel.
Figure 10:
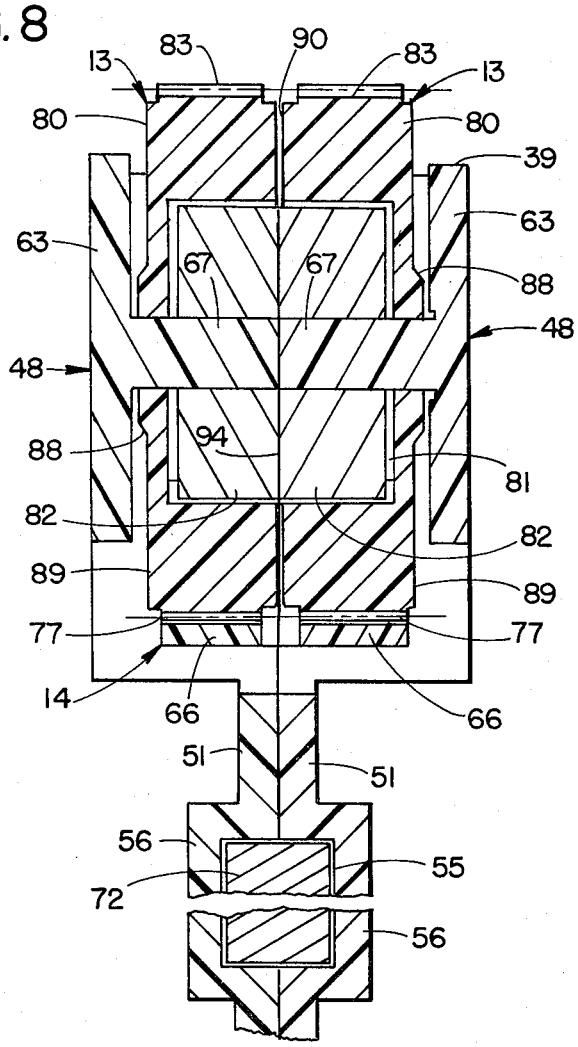
FIG. 10 is an enlarged, fragmentary, vertical cross-sectional view of the compensator, taken along the line X—X, FIG. 7.

With reference to FIGS. 8–10, the wheel-magnet assembles 13 comprise a circular adjustment wheel or disc 80 constructed of a non-magnetic material, such as the polymer known as Lexan or the like, having a central recess or aperture 81 in which a rectangularly-shaped magnet 82 is received. Wheel 80 has a serrated peripheral marginal edge 83 which is particularly adapted for frictional engagement with a human finger, to rotate the wheel assembly. In this example, the teeth on the wheel marginal edge have an inverted V-shape, with the sidewalls mutually inclined approximately 120°, and with a root depth in the nature of 0.0102 inches, so as to mate with spring detents 77. The illustrated teeth are circumferentially spaced about 6° apart, to achieve adjustment in extremely small increments for very fine adjustment. Recess 81 has a generally circular planar shape (FIG. 8), with rectangular corners 84 and flat or linear ends 85, thus forming a socket in which a rectangular magnet 82 is telescopingly received. The central axis of wheel 80 includes an aperture 86 therethrough (FIG. 9) which is concentric with the marginal edge 83 of the wheel, and shaped to rotatably mount the wheel assembly on pin 67 of the housing half 48. In like manner, magnet 82 includes a central aperture 87 through which pin 67 extends. An inclined collar 88 is formed on the exterior side 89 of wheel 80, and acts as a spacer and bearing. Recess 81 opens to the interior surface 90 of wheel 80, wherein arcuately-shaped areas 91 may be provided to designate the manufacturer and part number of the unit. The magnets 82 are permanent magets with opposite poles located at opposite ends of the same.

As best illustrated in FIG. 10, in the assembled condition, two wheel-magnet assemblies 13 are positioned laterally opposite one another to form a pair, and such pair is mounted on aligned pins 67 of a pair of oppositely-positioned and mutually-aligned housing halfs 48. It is preferred that the magnets in each wheel pair be positioned with their adjacent sides closely together in order to achieve accurate adjustment. In this example, the interior surfaces 90 of wheels 80 face each other, and collar 88 is positioned adjacent the interior side of pocket wall 63. The magnets 82 can slide slightly laterally on their pins 67 with respect to wheels 80, such that when their mutual poles are oriented so as to cause attraction therebetween, the flat interior sides 94 of the magnets are contiguous to each other and slide over one another when there is rotation of one wheel with respect to the other. A portion of the serrated peripheral edge 83 of each wheel 80 is engaged with the teeth 77 of the corresponding leaf spring 66. The tooth angle and interference between the wheel 80 and the leaf spring 66 are designed so that there is sufficient force to prevent inadvertent rotation of the wheel with respect to the housing, yet permit manual rotation of the wheel to adjust the compensator. Even though the wheels 10 in each pair are positioned very closely together, the rotational resistance provided by the detented spring 66 permits the operator to easily rotate just one such wheel, without unintentionally moving the other wheel out of adjustment. Rotation of wheels 80 with respect to the housing causes a clicking sound and a corresponding detenting action and feeling as the serrations on the marginal edge of the rotated wheel snap past the corresponding teeth on the leaf spring.

Each of the illustrated compensators 1 includes three pairs of wheel-magnet assemblies 13, pivotally mounted in the housing pockets 63 on pins 67. It is to be understood, however, that a single magnet arrangement, or other numerical combination, can be used to alleviate varying degrees and patterns of CRT distortion, and the same are therefore contemplated by the present invention. However, the illustrated arrangement of three pairs of wheel-magnet assemblies 13 per compensator is preferred for the abovedescribed type of deflection yoke 5. Housing 12 consistently locates each wheel-magnet pair in a predetermined orientation with respect to yoke 5, and to the other wheel-magnet pairs. Preferably, each wheel-magnet 13 is disposed in a plane perpendicular to the central axis of yoke sleeve 6, and the two compensators on yoke 5 are diametrically opposite each other, with the radial distance between the yoke sleeve axis and the rotational axis of each of the wheel-magnet assemblies 13 being equal. In this manner, each wheel-magnet pair can be precisely oriented in both the radial and axial planes.

In use, an assembled compensator 10 is mounted upon both the left and right-hand sides of deflection yoke 11. In so doing, the radially-interior flange 49 of each compensator 10 is inserted into the channel 43 formed between foward collar 20 and flange 40 of the yoke, until the barbed end 69 of compensator prong arm 68 snaps over the edge of flange end 41, thereby forming a snap lock which securely but releasably mounts the compensator upon the deflection yoke. Flanges 49 of the compensator housing halves orient the housings such that the plane of rotation of the wheel-magnet assemblies 13 is substantially perpendicular to the central axis of yoke sleeve 22. Further, the left and right-hand compensators are maintained in a substantially coplanar orientation by the flanges 49.

Compensators 10 can be attached to deflection yoke 11 either before or after the deflection yoke is attached to the CRT 27. In either event, to adjust compensators 10, the operator activates the CRT and displays a test pattern on screen 30. The operator then manipulates (i.e., rotates) the wheel-magnet assemblies 13 so as to alleviate distortion in the images formed on the screen. With respect to the embodiment illustrated in FIG. 2, it has been determined that the upper pair of wheels alleviates distortion near the upper marginal edge of the screen, the lower pair of wheels alleviates distortion along the lower edge of the screen, and the center wheel pairs alleviate distortion between the upper and lower edges, as well as the side edges of the CRT screen 30.

The wheel-magnet assemblies 13 of each pair can be rotated simultaneously for fast, rough adjustments, as well as individually. To rotate any particular wheel, or pair of wheels, the operator merely engages the protruding portion of the wheel or wheels with his thumb or finger, and urges the same in the desired direction of rotation. The torque applied to each wheel by the operator causes the serrations or teeth around the marginal edge 83 of the wheel to push against and disengage from the detents 77 on leaf spring 66 by flexing the leaf spring slightly in a direction radially away from the wheel, thereby allowing the wheel to rotate one notch at a time, and simultaneously creating a clicking or snapping noise along with a corresponding vibration. The sound and vibration of wheel rotation facilitates accurate rotational adjustment of the magnet and corresponding magnetic field, to augment alleviation of image distortion. By simply removing the finger, force (rotational torque) applied to the wheel, the leaf spring automatically and positively retains the wheel in the selected position.

The wheel-mounted magnet and housing arrangement of compensator 1 precisely orients the various magnets 82 and their corresponding fields, with respect to both each other and the coils 23 and 24 of deflection yoke 11, so that the CRT can be easily and accurately adjusted to achieve minimal distortion. The detented leaf springs 66 positively yet releasably retain the wheel-magnet assembles 13 in their adjusted position, so that they are not likely to be inadvertently moved, and also so that they emit a snapping sound and corresponding physical vibration when rotated, to facilitate accurate adjustment. The compensators 10 are easily mounted upon deflection yoke 11, securely held in position, and oriented with respect thereto in a consistent fashion. Compensator 10 greatly reduces the time and difficulty required to compensate deflection yoke 11, while also improving the degree of readily-obtainable compensation. The two-piece housing 12 with interchangeable halves 48 provide an economical construction which is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A compensator for CRT deflection yokes and the like, comprising:

a housing adapted for fixed mounting adjacent a CRT deflection yoke;

at least one magnet;

a wheel comprising a manually rotatable carrier for said magnet, said wheel including means for carrying said magnet adjacent to and generally in the same plane with said wheel;

means for rotatably mounting said wheel and the said magnet carried therewith upon said housing; and means for positively and releasably engaging said wheel to thereby retain said magnet in a selected position of wheel rotation with respect to said housing, to thereby enhance selective positioning of said magnet altering the effective electromagnetic field produced by the deflection yoke to alleviate distortion in the CRT display, and to maintain such selected magnet position;

said housing being adapted for mounting in a position in which it at least partially encircles the longitudinal axis of the CRT with the housing disposed in a plane generally perpendicular to said CRT axis, and said magnet having oppositely-disposed poles and being carried by said wheel for rotation about an axis disposed generally perpendicular to said plane of said housing and generally parallel to the said CRT axis.

2. A compensator for CRT deflection yokes and the like, comprising:

a housing adapted for fixed mounting adjacent a CRT deflection yoke;

at least one magnet;

a wheel comprising a manually rotatable carrier for said magnet, said wheel including means for carrying said magnet adjacent to and generally in the same plane with said wheel and for mounting said magnet in said wheel generally coaxially therewith;

means for rotatably mounting said wheel and the said magnet carried therewith upon said housing; and means for positively and releasably engaging said wheel to thereby retain said magnet in a selected position of wheel rotation with respect to said housing, to thereby enhance selective positioning of said magnet altering the effective electromagnetic field produced by the deflection yoke to alleviate distortion in the CRT display, and to maintain such selected magnet position;

said means for releasably engaging said wheel means comprising a spring-biased member contacting the circumferential periphery of said wheel.

3. A compensator as set forth in claim 2, wherein:

said wheel includes a partially-exposed peripheral edge, and wherein said edge is serrated around the periphery of the wheel.

4. A compensator as set forth in claim 5, including:

a second magnet rotatably carried by a second wheel mounted in said housing adjacent said first-named wheel and magnet, for rotation in a substantially parallel plane therewith.

5. A compensator as set forth in claim 4, wherein:

said first and second wheel-mounted magnets are disposed side-by-side and coaxial to form a first pair, and wherein said magnet-carrying wheels can be rotated both individually and together.

6. A compensator as set forth in claim 2, including:

second and third wheel-mounted magnet devices mounted on said housing and spaced circumferentially with respect to said CRT from said first such wheel-magnet and from each other.

7. A compensator as set forth in claim 6, including:

a stationary magnet fixedly mounted in said housing with a lateral central axis thereof positioned along a radially extending line disposed symmetrical with said first, second, and third wheel-mounted magnets.

8. A compensator for CRT deflection yokes and the like, comprising:

a housing adapted for fixed mounting adjacent a CRT deflection yoke;

at least one magnet;

a wheel comprising a manually rotatable carrier for said magnet, said wheel including means for carrying said magnet adjacent to and generally in the same plane with said wheel;

means for rotatably mounting said wheel and the said magnet carried therewith upon said housing; and means for positively and releasably engaging said wheel to thereby retain said magnet in a selected position of wheel rotation with respect to said housing, to thereby enhance selective positioning of said magnet altering the effective electromagnetic field produced by the deflection yoke to alleviate distortion in the CRT display, and to maintain such selected magnet position;

said magnet being mounted upon said wheel to rotate therewith;

said wheel including a partially-exposed peripheral edge which is serrated; and said wheel-engaging means comprising a spring member engaging said serrated wheel edge to provide ratcheting detented wheel position retention.

9. A compensator as set forth in claim 8, including:

a second wheel-mounted magnet rotationally mounted in said housing adjacent said first-named wheel and magnet for rotation in a substantially parallel plane therewith; said first and second wheel-mounted magnets being disposed side-by-side and coaxially, to form a first pair; and second and third pairs of wheel-mounted magnets mounted in said housing and spaced circumferentially with respect to said CRT from said first pair and from each other.

10. A compensator as set forth in claim 1, wherein:

said magnet is mounted in a wheel and rotates coaxially therewith;

said wheel includes a partially exposed, serrated marginal edge adapted for grasping; and said retaining means comprises a leaf spring member disposed in said housing at the base of said wheel, said leaf spring member including projecting detent means for mating with and releasably engaging the serrated marginal edge of said wheel.

11. A compensator for CRT deflection yokes and the like, comprising:

a housing adapted for fixed mounting adjacent a CRT deflection yoke;

at least one magnet;

a wheel comprising a manually rotatable carrier for said magnet, said wheel including means for carrying said magnet adjacent to and generally in the same plane with said wheel;

means for rotatably mounting said wheel and the said magnet carried therewith upon said housing; and means for positively and releasably engaging said wheel to thereby retain said magnet in a selected position of wheel rotation with respect to said housing, to thereby enhance selective positioning of said magnet altering the effective electromagnetic field produced by the deflection yoke to alleviate distortion in the CRT display, and to maintain such selected magnet position;

said housing being split in a plane generally perpendicular to the axis of said CRT and including two portions between which said wheel is disposed.

12. A compensator as set forth in claim 11, wherein:

said housing portions are substantially identical half portions.

13. A compensator for CRT deflection yokes and the like, comprising:

a housing adapted for fixed mounting adjacent a CRT deflection yoke;

at least one magnet;

a wheel comprising a manually rotatable carrier for said magnet, said wheel including means for carrying said magnet adjacent to and generally in the same plane with said wheel;

means for rotatably mounting said wheel and the said magnet carried therewith upon said housing; and means for positively and releasably engaging said wheel to thereby retain said magnet in a selected position of wheel rotation with respect to said housing, to thereby enhance selective positioning of said magnet altering the effective electromagnetic field produced by the deflection yoke to alleviate distortion in the CRT display, and to maintain such selected magnet position;

said housing including mounting means comprising a pair of barbed prongs extending from opposite sides of said housing and molded integrally therewith, said prongs having a shape adapting them to engage portions of said CRT deflection yoke, to thereby retain said housing thereupon.

14. A compensator as set forth in claim 13, wherein:

said magnet is mounted in a wheel and rotates generally coaxially therewith;

said wheel includes a partially exposed, serrated marginal edge adapted for grasping; and said retaining means comprises a spring member disposed in said housing at the base of said wheel, said spring member including projecting detent means for mating with and releasably engaging the serrated marginal edge of said wheel.

* * * * *